US008844631B2

(12) United States Patent
Anderson et al.

(10) Patent No.: US 8,844,631 B2
(45) Date of Patent: Sep. 30, 2014

(54) DEBRIS REMOVAL SYSTEM FOR DOWNHOLE CLOSURE MECHANISM, AND METHOD THEREOF

(75) Inventors: David Z Anderson, Tulsa, OK (US); Michael L. Hair, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 443 days.

(21) Appl. No.: 13/307,953

(22) Filed: Nov. 30, 2011

(65) Prior Publication Data

US 2013/0133893 A1 May 30, 2013

(51) Int. Cl.
*E21B 37/00* (2006.01)

(52) U.S. Cl.
USPC ..... 166/311; 166/332.8

(58) Field of Classification Search
USPC ..... 166/311, 332.8
See application file for complete search history.

(56) References Cited

U.S. PATENT DOCUMENTS 2,645,290 A * 7/1953 Fortenberry ..... 166/99
4,515,212 A * 5/1985 Krugh ..... 166/99
5,343,955 A * 9/1994 Williams ..... 166/386
6,158,512 A * 12/2000 Unsgaard ..... 166/311
6,269,874 B1 8/2001 Rawson et al.
6,272,187 B1 8/2001 Rick
7,204,313 B2 4/2007 Williams et al.
7,270,191 B2 9/2007 Drummond et al.
7,347,269 B2 3/2008 Layton
7,896,082 B2 3/2011 Lake et al.
2010/0108320 A1 5/2010 Larnach

OTHER PUBLICATIONS

Rogelio Higa, SPE, Pemex; Percy A. Saavedra, SPE, Welltec, "Case Story: Rigless Debris Removal From a Subsea Safety Valve With a Wishbone Honer Brush on Electric Line", Paper was preapred for a presentation at SPE/ICoTA Coiled Tubing & Well Intervention Conference & Exhibition, The Woodlands, Texas, USA, Mar. 27-28, 2012, SPE 154411, Society of Petroleum Engineers.

* cited by examiner

*Primary Examiner* — Cathleen Hutchins
(74) *Attorney, Agent, or Firm* — Cantor Colburn LLP

(57) ABSTRACT

A debris removal system includes a tubular. A closure mechanism arranged to at least partially close an interior of the tubular. An injector mechanism having an exit arranged downhole of the closure mechanism; wherein debris removing material ejected from the injector mechanism is directable towards the closure mechanism. Also included is a method of removing debris in a downhole tubular.

20 Claims, 3 Drawing Sheets

DEBRIS REMOVAL SYSTEM FOR DOWNHOLE CLOSURE MECHANISM, AND METHOD THEREOF

BACKGROUND

In the drilling and completion industry, the formation of boreholes for the purpose of production or injection of fluid is common The boreholes are used for exploration or extraction of natural resources such as hydrocarbons, oil, gas, water, and CO2 sequestration.

Surface-controlled, subsurface safety valves ("SCSSV's") are typically used in production string arrangements to quickly close off the production borehole in the event of an emergency, such as a blowout. A usual form for an SCSSV is a flapper-type valve that includes a flapper member that is pivotally movable between open and closed positions within the borehole. The flapper member is actuated between the open and closed positions by a flow tube that is axially movable within the borehole.

After being placed into a borehole, mineral scale typically forms and builds up on all portions of the production tubing string that are exposed to borehole fluids. Scale and other buildup forming on and around the flow tube of the SCSSV can make it difficult to move the flow tube axially and thereby require more maintenance with respect to proper operation of the SCSSV. Prior devices for cleaning and removing or preventing scale buildups have focused on the interior surface of the borehole within the valve housing, as scale buildup in that location can inhibit the flow tube from moving axially and inhibit the valve from closing optimally. One such device includes wireline brushes, however this is costly as it necessitates stopping production operations to run the brush in and then conduct the cleaning. Another such device includes a wiper member that extends radially outwardly from the flow tube and into contact with an interior surface of the valve housing, which can counteract the effect of scale buildup and also operate to physically wipe away scale buildup. Another method for removing scale and debris buildup uses explosive charges. The use of explosives, however, carries with it risks of damage to valve components as well as the potential for damage to the production tubing string. Yet another method reduces the harmful effects of scale and debris build up by exercising the safety valve through operation of its components, to ensure any build up does not reach a point where the safety valve is no longer fully operational.

The art would be receptive to additional devices and methods for dealing with scale and debris buildup, particularly for areas not accessible using conventional cleaning techniques.

BRIEF DESCRIPTION

A debris removal system includes a tubular; a closure mechanism arranged to at least partially close an interior of the tubular; and, an injector mechanism having an exit arranged downhole of the closure mechanism; wherein debris removing material ejected from the injector mechanism is directable towards the closure mechanism.

A method of removing debris in a downhole tubular having a closure mechanism, the method includes moving a debris removing material from an uphole surface location in a downhole direction to a position longitudinally passed a flapper member of the closure mechanism; and subsequently injecting the debris removing material towards a downhole facing surface of the flapper member when the flapper member is in a closed position blocking the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
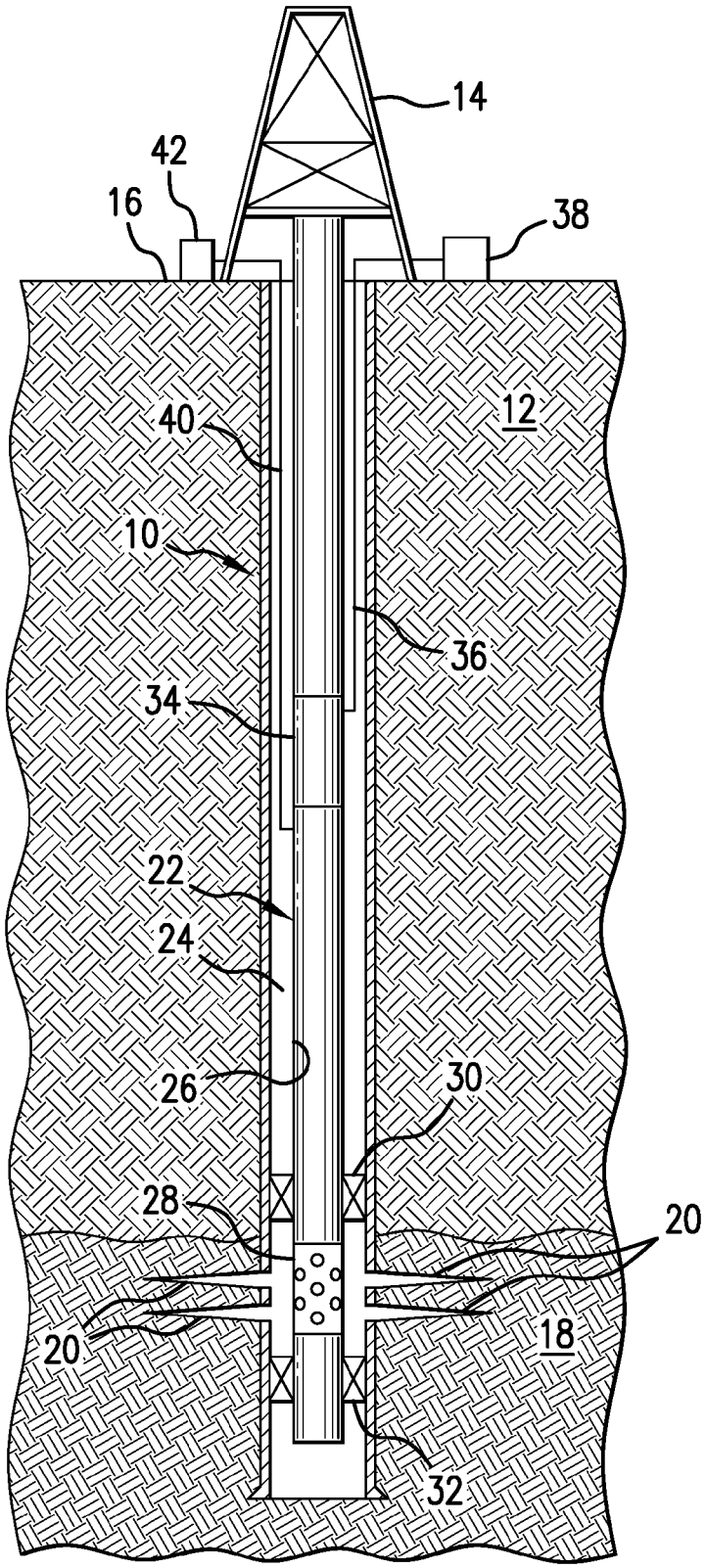
FIG. 1 depicts a cross sectional view of an exemplary production tubing string within a borehole and containing an exemplary debris removal system for a SCSSV.

As shown in FIG. 1, an exemplary borehole 10 is drilled through the earth 12 from a drilling rig 14 located at the surface 16. The borehole 10 is drilled down to a hydrocarbon-bearing formation 18 and perforations 20 extend outwardly into the formation 18.

An exemplary production tubing string 22 extends within the borehole 10 from the surface 16. An annulus 24 is defined between the production tubing string 22 and a wall of the surrounding borehole 10. The production tubing string 22 may be made up of sections of interconnected production tubing, or alternatively may be formed of coiled tubing. A production flowbore 26 passes along a length of the production tubing string 22 for the transport of production fluids from the formation 18 to the surface 16. A ported section 28 is incorporated into the production tubing string 22 and is used to flow production fluids from the surrounding annulus 24 to the flowbore 26. Packers 30, 32 secure the production tubing string 22 within the borehole 10.

The production tubing string 22 also includes a surface-controlled subsurface safety valve ("SCSSV") 34. The SCSSV 34 is used to close off fluid flow through the flowbore 26 and may include a flapper valve, as will be described with respect to FIG. 2. The general construction and operation of flapper valves is well known in the art. Flapper valve assemblies are described, for example, in U.S. Pat. No. 7,270,191 by Drummond et al. entitled "Flapper Opening Mechanism" and U.S. Pat. No. 7,204,313 by Williams et al. entitled "Equalizing Flapper for High Slam Rate Applications" which are herein incorporated by reference in their entireties. A hydraulic control line 36 extends from the SCSSV 34 to a control pump 38 at the surface 16. As will be further described below with respect to FIG. 2, an additional control line 40 extends from a control pump 42 at the surface 16, or at another accessible location, to the production tubing string 22 at a location longitudinally downhole of the SCSSV 34.

Figure 2:
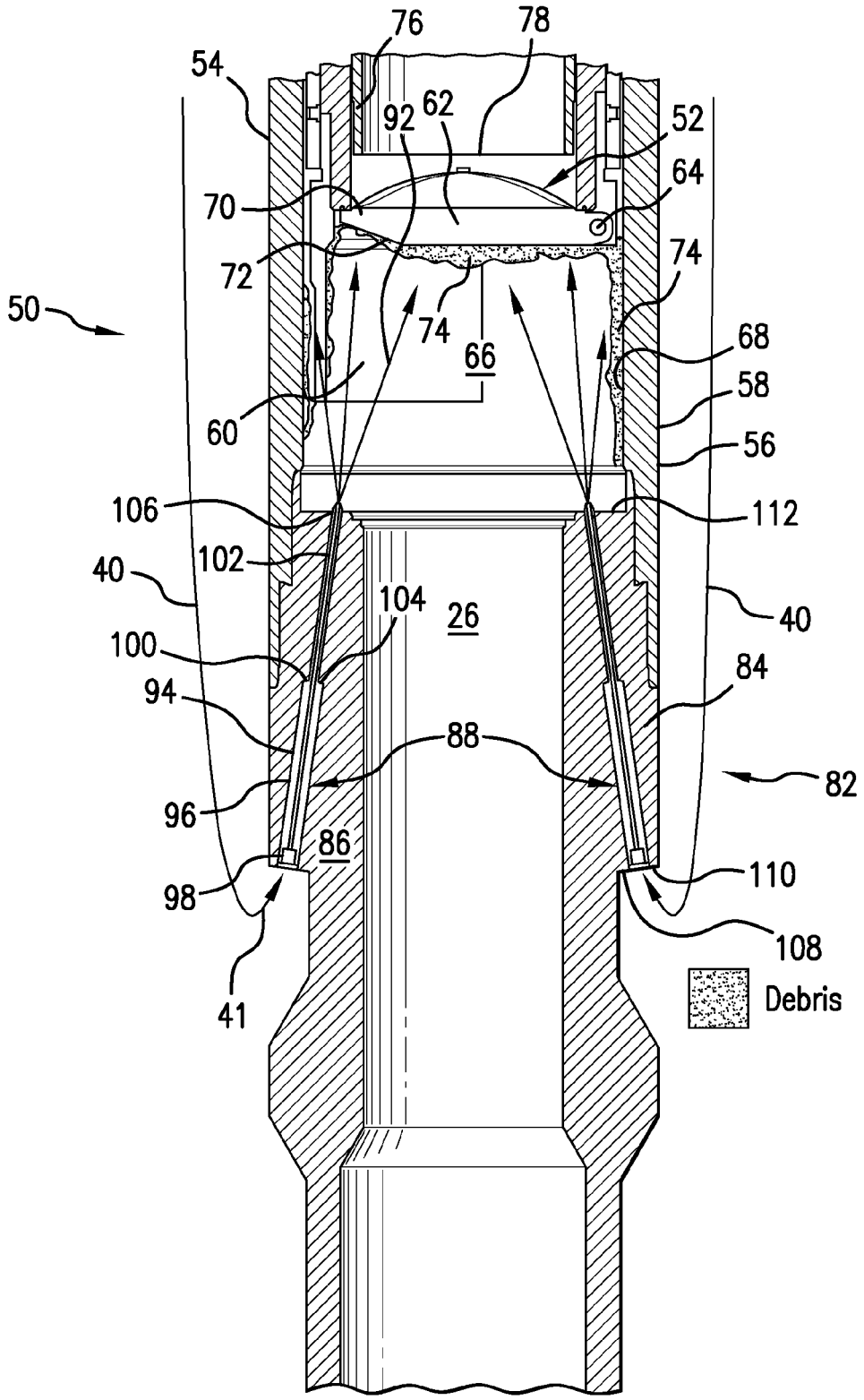
FIG. 2 depicts a cross-sectional view of an exemplary embodiment of a debris removal system with a closure mechanism in a closed condition.
Figure 3:
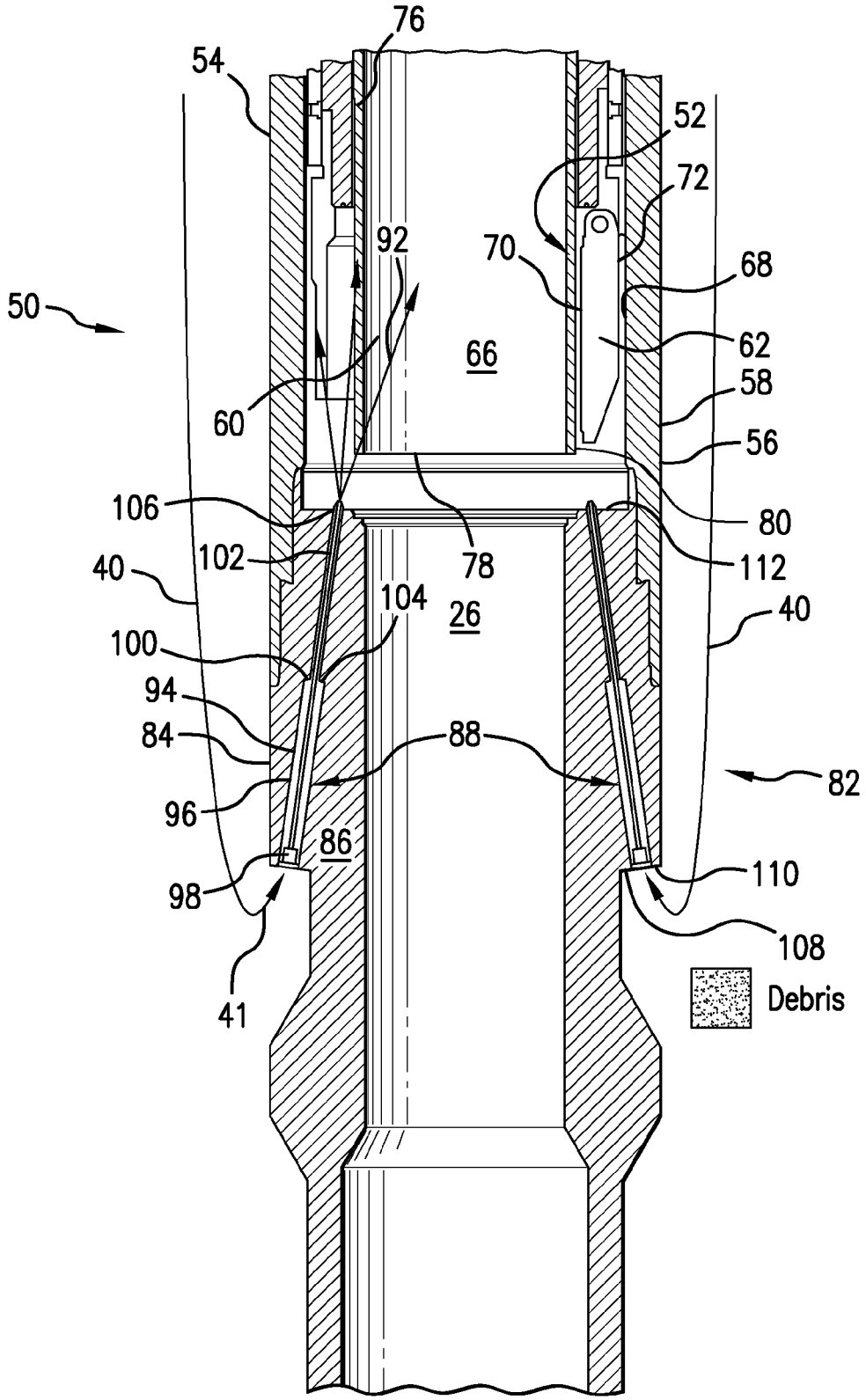
FIG. 3 depicts a cross-sectional view of the debris removal system of FIG. 2 with the closure mechanism in an open condition.

Turning now to FIG. 2, an exemplary embodiment of a debris removal system 50 including a closure mechanism 52 is shown. The closure mechanism 52 is usable as the SCSSV 34 of FIG. 1, however the closure mechanism 52 may be used in other areas and systems requiring valve functions. The closure mechanism 52 includes a tubular 54 having a housing 56 with a central flowbore 26 that becomes a portion of the flowbore 26 of the production tubing string 22 of FIG. 1 when the housing 56 is integrated into the production tubing string 22 of FIG. 1. In the illustrated embodiment, the housing 56 includes a first housing sub 58 and a flapper housing 60 positioned radially inward of the first housing sub 58, however the housing 56 may alternatively be differently designed, such as by integrally combining the first housing sub 58 and flapper housing 60. A pivotable flapper member 62 is retained upon a pivot pin 64 within a flapper member cavity 66 in the flapper housing 60. The flapper member 62 is movable about the pivot pin 64 between an open position where the flapper member 62 lies against an inner wall 68 of the housing 56, as depicted in FIG. 3, wherein fluid can pass through the central flowbore 26, and a closed position, illustrated in FIG. 2, wherein flow through the flowbore 26 is blocked by the flapper member 62, which extends across a diameter of the housing 56. The flapper member 62 is biased toward the closed position shown in FIG. 2, typically by a torsional spring (not shown), in a manner known in the art.

The flapper member 62 includes a first surface 70 and an opposed second surface 72. In the closed position shown in FIG. 2, the first surface 70 faces an uphole direction, and the opposed second surface 72 faces the downhole direction. As is understood in the art, the uphole direction would be a direction pointing towards the surface 16, while a downhole direction would be opposite the uphole direction and further down the borehole 10. Typically, the flapper member 62 has a shape sized to fit an interior perimeter of the housing 56, such as a substantially circular shape, so that, in the closed position, flow is prevented from traveling past the flapper member 62. An area uphole of the first surface 70 of the flapper member 62 in the closed position may have an inner diameter that is smaller than an outer diameter of the flapper member 62, such that when the flapper member 62 is closed as shown in FIG. 2, the flowbore 26 is completely blocked. As shown in FIG. 3, when the flapper member 62 is in the open position, the first surface 70 faces the flowbore 26 and the second surface 72 faces the inner wall 68 of the housing 56.

The flapper cavity 66 is formed downhole of the second surface 72 of the flapper member 62 in the closed position of the flapper member 62. Although the flapper cavity 66 is still present in the open position of the flapper member 62, it is when the flapper member 62 is in the closed position for a period of time that debris 74 begins to collect within the flapper cavity 66 and on the second surface 72 of the flapper member 62.

A flow tube 76 is also disposed within the housing 56 and is axially movable with respect to the housing 56 between an uphole position shown in FIG. 2 and a downhole position shown in FIG. 3. The flow tube 76 may be biased toward the uphole position by a compressive spring (not shown). When the flow tube 76 is in the uphole position, the flapper member 62 is allowed to move to its biased closed position shown in FIG. 2, such as by the torsional spring (not shown). The flow tube 76 may be hydraulically activated to move in the downhole direction by the pump 38 via the control line 36. When a compressive spring is used to bias the flow tube 76 in the uphole position, the compressive bias must be overcome for the flow tube 76 to move downhole. When the flow tube 76 is actuated to move in the downhole direction, a downhole end 78 of the flow tube 76 abuts with the first surface 70 of the flapper member 62, pivoting the flapper member 62 on the pivot pin 64 towards the inner wall 68 of the housing 56. With the flow tube 76 retained in this condition, the flapper member 62 is forced in the open position by being trapped between an outer surface 80 of the flow tube 76 and the inner wall 68 of the housing 56. While a flow tube 76 has been described as the opening vehicle of the flapper member 62, alternative mechanisms for opening the flapper member 62 may also be employed.

When SCSSV's 34 are installed in a completion there are times in which the flapper member 62 can sit dormant in the closed position for extended amounts of time, exposing the second surface 72 of the flapper member 62 and flapper cavity 66 to production fluid and debris 74. Debris 74 can build up in these areas inhibiting the flapper member 62 from swinging to the full open position and allowing the flow tube 76 to travel fully past it. This can cause the closure mechanism 52 to be difficult to fully open. Thus, the debris removal system 50 includes an injector mechanism 82 to break up debris 74 in the flapper cavity 66 and the second surface 72 of the flapper member 62 using injector mechanism 82, which may be controlled from the surface 16 without the need of expensive well intervention.

As shown in FIGS. 2 and 3, a second housing sub 84 is attached to the first housing sub 58, and located downhole of the first housing sub 58. In an exemplary embodiment of the present invention, the second housing sub 84 could be configured with any connection means needed to attach to an existing closure mechanism 52, in a manner similar with the connection of adjacent tubulars in string 22. In an alternative exemplary embodiment, a tubing joint (not shown) may be used to connect the adjacent first housing sub 58 to the second housing sub 84. In yet another exemplary embodiment, the first and second housing subs may be integrally combined. In any of the above described configurations, the first and second housing subs 58, 84 may be considered part of the housing 56 of the debris removal system 50. The housing 56 and any additional portions of a string 22 form the tubular 54 in the debris removal system 50.

The wall 86 of the second housing sub 84 downhole of the closure mechanism 52, which also forms a wall of the tubular 54, is provided with ample wall thickness to facilitate the incorporation of the injector mechanism 82. The injector mechanism 82 includes high pressure injectors 88 installed in the second housing sub 84. At least one control line 40 will be run to these injectors 88. In an exemplary embodiment, each injector 88 could be connected to a separate control line 40. Alternatively, one control line 40 could be connected to multiple injectors 88, such as via a RHN (Rawson Hickey Nose) chamber connection provided by Baker Hughes, Inc., as shown and described in U.S. Pat. No. 6,269,874 to Rawson et al., herein incorporated by reference in its entirety, where the multiple injectors 88 are installed about the second housing sub 84, such as in, but not limited to, a circular pattern. The control line 40, or lines 40, is fluidically connected to the one or more of the injectors 88 and supplies debris removing material 92 to one or more of the injectors 88 from the control pump 42. In an exemplary embodiment, and via surface control, one or more selected injectors 88 are selectively provided with debris removing material 92 or other injection material, depending on the areas requiring debris removal. In an exemplary embodiment, an injector profile path or flow path 94 is machined directly into the second housing sub 84 to eliminate the need for an additional injector component (or assembly.) High pressure control line 40 can be plumbed to the second housing sub 84 and pressurized to break up debris 74. Anti-corrosion fluid, anti-scale chemicals or scale inhibitors, foaming agents, cleaning liquids and materials, or any other debris removing materials can be used as the debris removing material 92.

An exemplary injector 88 is essentially a nozzle that directs and increases the speed of the material 92 flowing from the control line 40. The exemplary injector 88 includes a first section 96 connected to a downhole end 41 of the control line 40. The first section 96 has a first end 98 having a larger diameter than a second end 100 thereof. The injector 88 also includes a second section 102 having a first end 104 connected to the second end 100 of the first section 96 and a second end 106. The second section 102 may have a smaller diameter than the first section 96, or may simply be a flow path for the material 92 from the first section 96. The second end 106 of the second section 102 is an exit opening of the injector 88 that opens to the flapper cavity 66 and is pointed toward the second surface 72 of the flapper member 62. The size of the cone of spray exiting the second end 106 will partially dictate the force that the material 92 will be sprayed onto the flapper member 62 and in the flapper cavity 66. That is, the smaller the cone, the larger the force. Varying nozzle exit openings at the second end 106 may be employed depending on the anticipated force required of the injector mechanism 82. In order to direct injected material 92 towards the flapper cavity 66 and the second surface 72 of the flapper member 62 in the closed position, the first end 98 of the first section 96 of the injector 88 is located further downhole than the second end 106 of the second section 102. Thus, the material 92 ejected from the second end 106 of the second section 102 is directed in an uphole direction towards the flapper member 62. The second housing sub 84 may include a downhole facing shoulder 108 through which the first end 98 of the first section 96 of the injector 88 is accessed by the control line 40. As shown in FIG. 2, the flow path 94 for the injector mechanism 82 extends radially inward from an outer wall 110 of the second housing sub 84 to an inner wall 112 of the second housing sub 84 at a non-perpendicular angle to a longitudinal axis of the tubular 54. Thus, the nozzle shape of the injector 88 increases the speed of the injected material 92 radially inward at an uphole angle.

While the first end 98 of the flow path 94 of the injector 88 has been described as being further downhole than the exit opening second end 106 of the injector 88, in another exemplary embodiment, the first end is not further downhole than the exit opening second end, however a flow director such as a ramp or angled exit may be included at the exit opening second end of the injector to direct the injected material 92 in an uphole direction.

In an exemplary operation, the production tubing string 22, depicted in FIG. 1, is run into the borehole 10, and the closure mechanism 52 is set in the open position depicted in FIG. 3, wherein the flapper member 62 is in the open position and production through the production tubing string 22 can occur as is typical. In this position, the flow tube 76 is retained in the axially downhole position shown in FIG. 3, such that the flapper member 62 is pivoted against its bias towards the inner wall 68 of the housing 56. In the event of an emergency, system fault, or operator direction, the flow tube 76 is moved in an uphole direction to the position depicted in FIG. 2. The flapper member 62 will then rotate to the closed position shown in FIG. 2, thereby blocking fluid flow upwardly through the flowbore of the valve.

Operators will be able to initiate cleaning the surfaces in the flapper cavity 66, including the second surface 72 of the flapper member 62, the inside diameter of the flapper housing 60, etc. If this operation is conducted while the flapper member 62 is in the closed position, then the debris 74 would be free to drop to the bottom of the tubing string 22. This operation could be conducted many times throughout the life of the SCSSV 34 to keep debris 74 from building up in the flapper cavity 66. The flapper cavity 66 is unique as it is exposed to production fluid while the flapper member 62 is in the closed position; however, it cannot be accessed during standard cleaning operations currently being utilized as it is isolated by the flow tube 76 when the flapper member 62 is in the open position (as it would be during standard tubing cleaning operations.) While the debris removal system 50 is particularly useful for removing debris 74 when the closure mechanism 52 is in a closed condition, the debris removal system 50 is also usable when the closure mechanism 52 is in an open condition for removing debris 74 from other areas of the closure mechanism 52.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A debris removal system for a downhole tubular comprising:

the tubular;

a closure mechanism including a flapper member arranged to at least partially close an interior of the tubular;

a flow tube longitudinally movable within the tubular between an uphole position corresponding to a closed position of the flapper member and a downhole position corresponding to an open position of the flapper member, the flapper member configured to be trapped between the tubular and the flow tube in the open position; and, an injector mechanism having an exit arranged downhole of the closure mechanism;

wherein debris removing material ejected from the injector mechanism is directable towards the closure mechanism.

2. The debris removal system of claim 1, wherein the debris removing material ejected from the injector mechanism is directable in an uphole direction.

3. The debris removal system of claim 1, wherein the flapper member includes a first surface and an opposed second surface, the second surface facing a downhole direction in the closed position of the flapper member, and the material is ejected to remove debris from the second surface of the flapper member.

4. The debris removal system of claim 1, wherein the injector mechanism includes a nozzle.

5. The debris removal system of claim 1 wherein the tubular includes a tubular wall, the injector mechanism having at least one path formed through a thickness of the tubular wall.

6. The debris removal system of claim 5, wherein the at least one flow path includes a first end on an outer surface of the tubular wall and a second end on an inner surface of the tubular wall, wherein a longitudinal distance from the closure mechanism to the second end is less than a longitudinal distance from the closure mechanism to the first end.

7. The debris removal system of claim 5, wherein the at least one path extends radially inward at a non-perpendicular angle to a longitudinal axis of the tubular.

8. The debris removal system of claim 5, wherein the at least one path includes a first section having a first diameter at an outer surface of the tubular and a second section having a second diameter at an inner surface of the tubular, the second diameter smaller than the first diameter.

9. The debris removal system of claim 5, wherein the at least one path includes a plurality of paths, and further comprising a common control line fluidically connected to the plurality of paths.

10. The debris removal system of claim 1, wherein the tubular includes a first sub supporting the closure mechanism and a separately attachable second sub including the injector mechanism, wherein the second sub is downhole the first sub.

11. The debris removal system of claim 1 wherein the tubular includes a downhole end and an uphole end, production fluid in the tubular moves from the downhole end to the uphole end when the closure mechanism is in an open configuration, and is blocked from movement in an uphole direction by the closure mechanism in a closed configuration.

12. The debris removal system of claim 1, further comprising a control line extending to an opening of the injector mechanism and a control pump containing the debris removing material at a surface location.

13. The debris removal system of claim 1, wherein an opening of the injector mechanism, which receives the material, is arranged downhole of the exit of the injector mechanism.

14. The debris removal system of claim 1, wherein the tubular includes a downhole facing shoulder, an opening of the injector mechanism located on the shoulder.

15. A method of removing debris from a downhole facing surface of a flapper member of a subsurface safety valve in a downhole tubular, the method comprising:

moving a debris removing material from an uphole surface location in a downhole direction to a position longitudinally past the flapper member; and subsequently injecting the debris removing material towards the downhole facing surface of the flapper member when the flapper member is in a closed position blocking the tubular and preventing flow of production fluid from traveling past the flapper member.

16. The method of claim 15, wherein injecting the debris removing material includes injecting the debris removing material in an uphole direction.

17. The method of claim 15, wherein moving the debris removing material includes employing a control line from the uphole surface location to the position longitudinally past the flapper member.

18. The method of claim 15, wherein injecting the debris removing material includes employing an injector extending from an exterior to an interior of a wall of the tubular.

19. The method of claim 15, further comprising injecting the debris removing material when the flapper member is in an open position.

20. A debris removal system comprising:

a tubular;

a closure mechanism including a flapper member movable between an open position and a closed position, the flapper member in the closed position arranged to close an interior of the tubular and completely block flow of production travelling past the flapper member; and, an injector mechanism having an exit arranged downhole of the closure mechanism;

wherein debris removing material ejected from the injector mechanism is directable towards the closure mechanism.

* * * * *